United States Patent [19]

Abramson

[11] 4,060,304

[45] Nov. 29, 1977

[54] BATTERY CABLES AND PROCESS FOR MAKING SAME

[76] Inventor: Joseph O. Abramson, 5629 Edgewater Drive, Orlando, Fla. 32810

[21] Appl. No.: 701,682

[22] Filed: July 1, 1976

[51] Int. Cl.[2] ..... H01R 11/26

[52] U.S. Cl. ..... 339/224; 339/230 R

[58] Field of Search ..... 339/224–240

[56] References Cited

U.S. PATENT DOCUMENTS

| | | | |
|---|---|---|---|
| 1,078,751 | 11/1913 | Rogers | 339/224 X |
| 3,963,303 | 6/1976 | Hays | 339/237 |

FOREIGN PATENT DOCUMENTS

| | | | |
|---|---|---|---|
| 212,398 | 12/1960 | Austria | 339/230 R |

*Primary Examiner*—Roy Lake
*Assistant Examiner*—E. F. Desmond
*Attorney, Agent, or Firm*—Roylance, Abrams, Berdo & Kaul

[57] ABSTRACT

An improved form of battery cable is produced through the use of a battery terminal member which has a copper tube projecting from the end thereof. The multi-strand electrically conductive cable is cut to the desired length, the end is stripped and inserted into the copper tube and the copper tube is crimped into a diamond-shaped crimp to form a substantially solid mass of the cable strands wherein. Then, a plastic sleeve is heat shrunk over the copper tube and a portion of the cable sheath to form a corrosion-free connection.

11 Claims, 12 Drawing Figures

FIG. 1
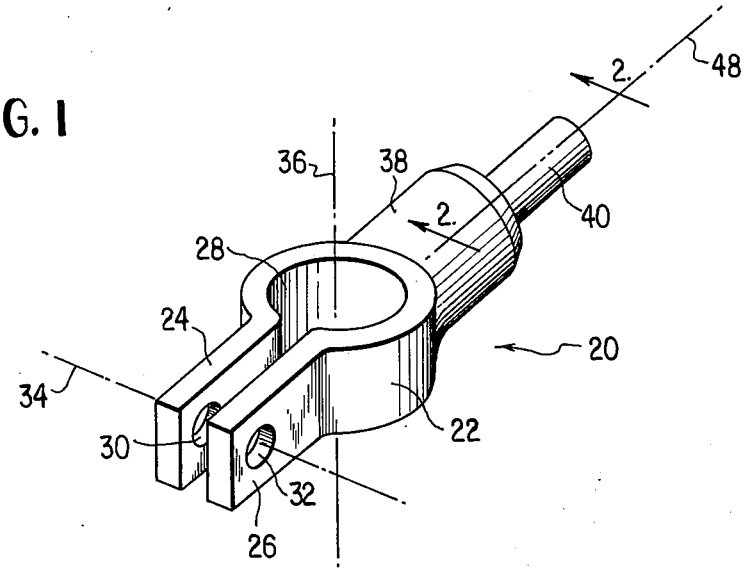
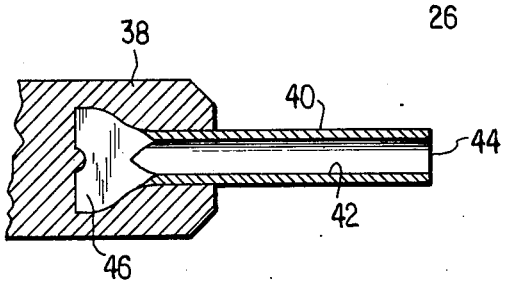
FIG. 2
FIG. 3
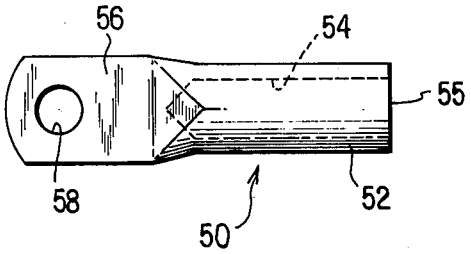
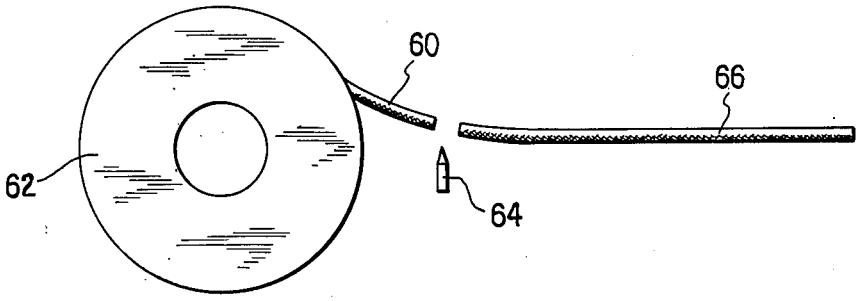
FIG. 4

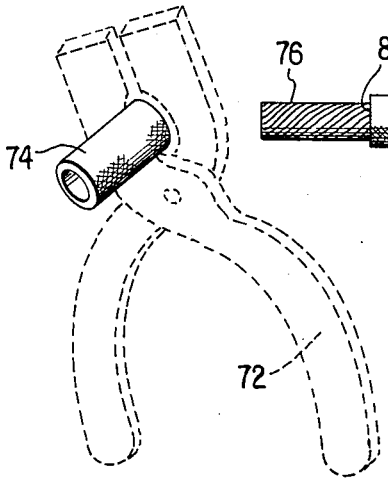
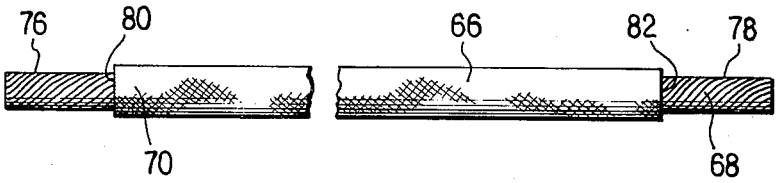
FIG. 5
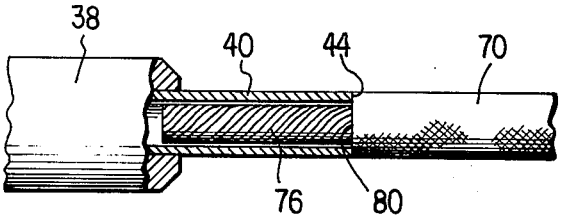
FIG. 6
FIG. 7
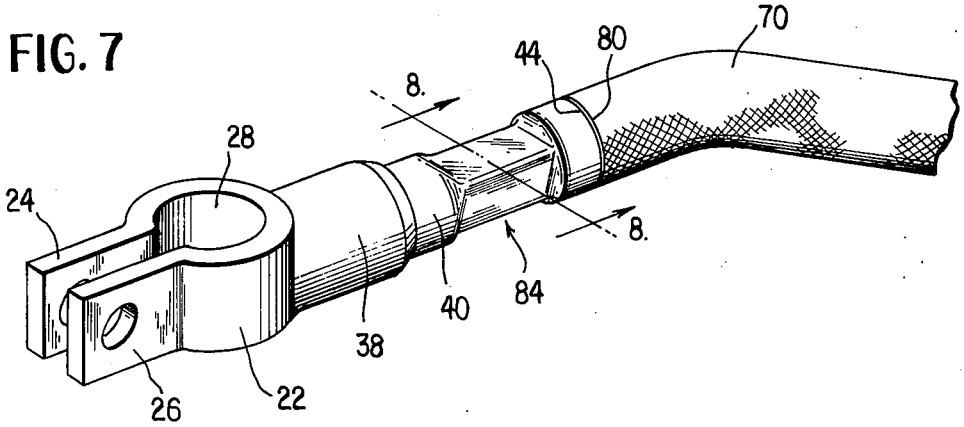
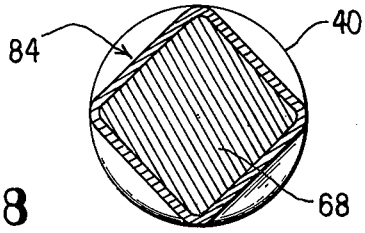
FIG. 8

FIG. 9
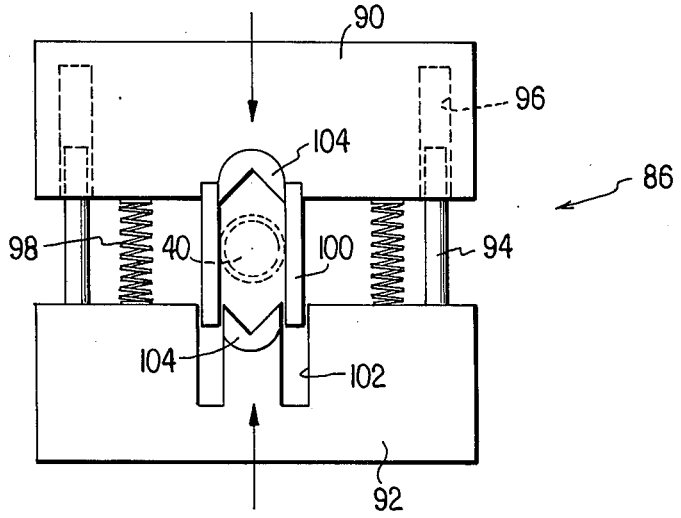
FIG. 10
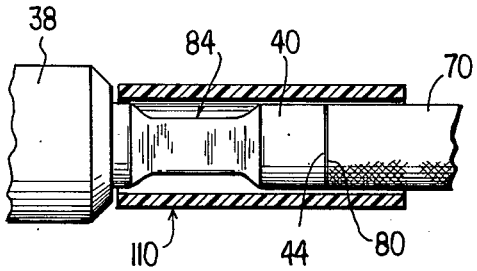
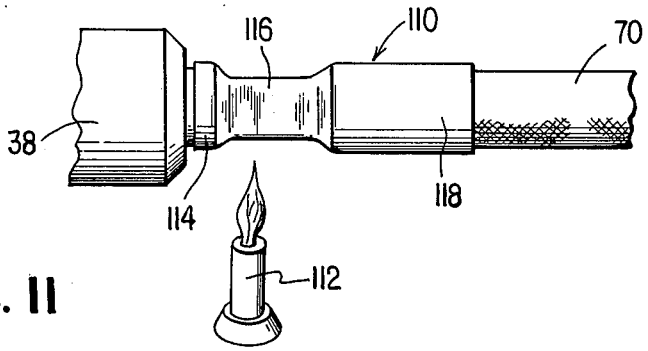
FIG. 11
FIG. 12
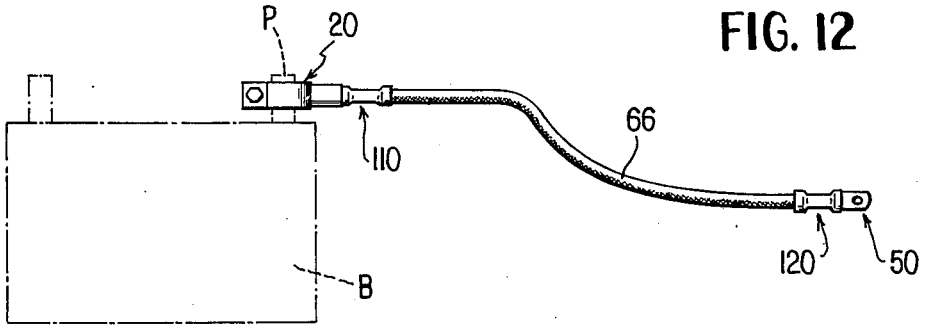

BATTERY CABLES AND PROCESS FOR MAKING SAME

This invention relates to battery cables and more particularly it relates to an improved form of battery cables, a terminal member utilized in the improved form of battery cable, and a process for producing the improved form a battery cable.

Battery cables are utilized to conduct electrical energy from a storage battery to an electrically operated component. Such battery cables are commonly used in automotive and marine applications where electrical power is supplied by means of a storage battery.

Battery cables have heretofore been provided as a completed unit of pre-selected length having a terminal member at one end for connection to a storage battery post and having a connection element at the other end for connecting the cable to an electrically operated element. With the large number of different models of automobiles and marine vehicles and the different placement of storage batteries in such vehicles, mechanics and others who work on such vehicles must either maintain or obtain a large variety of different length battery cables. Thus, as an example, an automobile service station which performs mechanical repairs on automobiles must stock a large variety of different battery cables in order to provide adequate servicing to its customers. If it does not have a particular length of battery cable in stock, then it must either use an oversize cable, or alternatively, delay work until a battery cable of the proper length is obtained from an automotive supply house.

In view of the foregoing, it is the primary object of the present invention to provide a method and means by which a battery cable can be quickly and easily produced to the proper length by a service facility.

Another object of the present invention is to provide a method for producing an improved battery cable which is "custom made" to the exact length which is required.

Another difficulty with existing forms of battery cables resides in their ability to operate for extended periods of time in a satisfactory manner. In this connection, it must be remembered that battery cables, when installed and connected to a storage battery, are subjected to continual vibrational stress during operation of the vehicle in which the battery is installed. Moreover, as batteries are removed for replacement for recharging, the cables themselves are often bent, pulled or otherwise distorted. Aside from all of these factors, it must be remembered that battery cables are highly subject to corrosive forces because of the electro-chemical reactions which occur at or adjacent to the storage battery.

In view of the foregoing, it has been discovered that many existing forms of battery cables do not provide satisfactory performance over extended periods of time. In some instances, the cable itself will tend to strip or separate away from the terminal member at the end thereof. In other instances, the electrically conductive copper cables will be exposed to corrosive action of the battery acid. In any of these events, the battery cable will eventually fail to perform its desired function and will have to be replaced.

It is an object of the present invention to overcome these difficulties and deficiencies and to provide an improved form of battery cable which can be inexpensively produced on site, yet which is capable of extended periods of operation without failure.

Another object of the present invention is to provide an improved form of battery terminal member for use as part of a battery cable and for use in the production of a battery cable.

Other objects, advantages and salient features of the present invention will become apparent from the following detailed description, which, taken in conjunction with the annexed drawings, disclosed a preferred embodiment thereof.

The foregoing objects are attained by providing at the site where the battery cable is to be installed, an elongated supply, such as a reel, of elongated electrically conductive cable formed by a multiplicity of wire strands having an insulating sheath extending along the exterior thereof. The invention also provides an improved form of battery terminal member having a main body formed of a suitable alloy and having an aperture formed therein, for insertion over and onto the post of a conventional storage battery. This terminal member also includes a projecting hollow tube, formed of copper, which extends from the rear end of the terminal member.

To produce a battery cable in accordance with the present invention, the operator cuts a preselected length of cable from the supply thereof, when strips the sheath away from the end portion of such cable to expose the wire strands at such ends. These wire strands are then inserted into the copper tube of the terminal member until such time as the sheath on the cable comes into abutment with the end of the copper tube. The tube is then subjected to crimping, by means of a simple crimping tool, to provide a tight inward compression of the wire strands to form such strands, at least within the tube, into a substantially solid mass. Advantageously, this crimping takes the form of a diamond-shaped crimp.

Following the crimping operation, a heat shrinkable sleeve is applied over the junction of the tube and sheath and is heated to shrink the same into tight engagement with the now crimped tube and with the end portion of the sheath. Once the sleeve has been so heated shrunk, the joint thus formed is corrosion-free.

Referring now to the drawings which form a part of this original disclosure:

FIG. 1 is a perspective view of a battery terminal member in accordance with the present invention;

FIG. 2 is a fragamentary sectional view of the terminal member taken along the line 2—2 of FIG. 1;

FIG. 3 is a side elevational view of a suitable connector member used at the end of the battery cable opposed to the end on which the terminal member is attached;

FIGS. 4–7 are sequential operational views showing the manner of production of the battery cable of the present invention;

FIG. 8 is a transverse sectional view through the crimped area of the battery cable, taken along the line 8—8 of FIG. 7.

FIG. 9 is a side elevational view of a suitable form of crimping device used to produce the battery cable of the present invention;

FIGS. 10 and 11 are diagrammatic views showing attachment of the heat shrinkable sleeve; and FIG. 12 is a diagrammatic view showing a completed battery cable in accordance with the present invention as the same would be attached to a storage battery.

Referring now to the present invention in further detail, there is shown in FIG. 1 an improved form of battery terminal member generally designated 20. This terminal member 20 includes a body 22 having a pair of forwardly projecting arms 24, 25 which circumscribe and define an aperture or opening 28 for reception of a storage battery post. The arms 24 and 26 have transverse bores 30 and 32 respectively extending therethrough, aligned along an imaginary axis 34 for the purpose of receiving a bolt and nut or other clamping device which can be used to move the arms relatively toward one another, thereby tightening the walls of the aperture 28 into engagement with the battery post. The aperture 28 is circumscribed and defined about an imaginary central axis 36 which is directed perpendicularly to the axis 34.

The battery terminal body 22 also includes a rear portion 38, advantageously cylindrical in configuration and integrally connected with the forward portion and the arms of the terminal member. The terminal member itself is preferably formed of a lead-zinc alloy.

A hollow tubular member 40 is integral with the body 22 and extends rearwardly of the rear end 38 thereof in a projecting manner. The tubular member 40 is advantageously fabricated of copper and is provided with an internal bore 42 which is cylindrical in configuration. The tube 40 has a straight rear end 44 and has a flattened forward end 46 which is embedded in the rear portion 38 of the terminal member. The width of the flattened forward end portion 46 of the tube exceeds the diameter of the tube 40, thus assuring that the tubular member cannot be inadvertently pulled from the terminal member. Also, as indicated in FIG. 1, the tubular member 40 is aligned along an imaginary axis 48 which is perpendicular to both the axis 34 and the axis 36. The bore 42 in the tubular member extends at least partially into the body rear portion 38 of the terminal member.

The metallic connector member to be attached to the opposite end of the battery cable is illustrated in FIG. 3 and is generally designated 50. Such element includes a hollow tubular body portion 52 having a bore 54 formed therein and having a flattened forward portion 56 through which an aperture 58 extends. The member 50 is advantageously formed of copper, and, if desired, can be exactly the same member which forms the tubular member 40, the only difference being that the flattened forward end 56 is severed transversely along the hole 58 therein in the manner illustrated in FIG. 2.

Referring now to FIG. 4, there is illustrated therein an elongated length of electrically conductive cable 60, advantageously supplied upon a reel 62 thereof. Any suitable form of cutting or severing element 64 can be used to cut a preselected length 66 of such cable from the supply thereof.

As shown in FIG. 5, the cable 66 includes a multiplicity of wire strands 68 covered by a protective insulating sheath 70, advantageously formed of rubber, plastic or the like. In FIG. 5, a suitable wire stripping tool 72 is used to strip away an end portion 74 of the sheath from each end of the cable section 66. When this section has been stripped away, it leaves an exposed set of strands 76 at one end and an exposed set of strands 78 at the opposite end. As a result, the sheath likewise has an end surface 80 and an end surface 82, such end surfaces being provided at opposed ends of the sheath.

As shown in FIG. 6, the exposed end 76 is inserted into the tubular member 40 until such time as the end 80 of the sheath abuts against the end 44 of the tube.

As shown in FIG. 7, the central portion of the tube 40 is crimped inwardly along a crimped area generally designated 84. The crimped area 84, as best shown in FIG. 8, is generally a diamond-shaped in cross section and the individual wire strands 68 therein are tightly compressed into a substantially solid mass within the crimped area 84. That is, the diameter of the exposed wire portion 76 is very slightly smaller than the diameter of the bore 42 in the tube 40 so that when the exposed wires are inserted into the tube, they substantially fill the interior thereof. Thus, when the walls of the tube are crimped inwardly as illustrated at 84, the wires within the crimped section are so tightly compressed together that they form a substantially solid mass within the crimped area. As a result of this crimping, it is not possible to pull the wires out of the tube even if an intense pulling force is attached to the cable.

While the crimping 84 can be accomplished by any suitable form of crimping device, an advantageous form of crimping tool generally designated 86 is illustrated in FIG. 9. This crimping tool can be operated by any conventional form of vise. The crimping tool 86 includes relatively movable upper and lower members 90 and 92, respectively. The lower member 92 has posts 94 which fit into and are guided within post recesses 96 in the member 90. Biasing springs 98 in the form of compression springs are provided between the members 90 and 92. A pair of spaced central guide plates 100 depend from the upper member 90 and fit into corresponding recesses 102 in the lower member 92. These plates 100 serve to define the channel into which the tube 40 is inserted. Upper and lower V-shaped crimping jaws 104 are provided between the plates 100. As a result, when the tube 40, with the exposed end 76 inserted therein as illustrated in FIG. 6, is inserted between the plates 100 and the members 90 and 92 are moved relatively toward one another in the direction of the arrows, as by operation of the vise, the jaws 104 move toward one another to form the generally diamond-shaped crimp 84 illustrated in FIG. 8.

Referring now to FIG. 10, a heat-shrinkable protective plastic tube or sheath 110 is shown. This tube or sheath 110 is applied to extend over the crimped portion 84 of the tube 40 and also to extend over the interface of the tube end 44 and the sheath end 80. As shown, the tube thus extends along a portion of the sheath 70 on the cable.

In FIG. 11, there is illustrated any suitable form of heat source 112, such as a candle, a match or the like, which is applied to the tube 110 to shrink the same into intimate contact with the underlying elements.

When the tube 110 is thus heat shrunk into position, it has three portions which can be designated 114, 116 and 118. The portion 114 extends over the innermost and uncrimped portion of the tube 40 and can extend forwardly as far as the rear end of the body portion 38 of the battery terminal member. The central section 116 extends over the crimped portion 84 of the tube. The rearmost portion 118 extends over the junction between the end 44 of the tube and the end 80 of the cable sheaths and additionally extends somewhat beyond that interface in intimate engagement with the cable sheath 80. When the sleeve 110 has been thus applied, the junction between the cable and the tube is completely sealed in a water tight and corrosion-free manner. Although not illustrated in detail, the opposite end of the cable is formed in a substantially similar manner to that previously described. That is, the stripped or exposed end 78 of wires are inserted into the bore 54 of the metallic connector member 50 until the end 82 of the sheath abuts against the end 55 thereof. Then, the tubular portion 52 is crimped inwardly by means of the crimping device 86 to lock the strands therein. Then, a further protective sheath 120, identical to the sheath 110, is applied over the crimped area and the abutment between the ends 55 and 82 and is heat shrunken into position. This completes formation of the battery cable.

As shown in FIG. 12, the battery cable can then be utilized by applying the same over the post P of a conventional storage battery B and the end member 50 is connected as necessary to the element which is to receive electrical energy from the battery B.

If a separate lead wire is required, to serve for example as a ground wire to an alternator, such lead wire can be provided by utilizing a separate wire one end of which can be inserted into the tube prior to crimping.

After reading the foregoing detailed description, it will be apparent that the object set forth at the outset hereof have been successfully achieved by the present invention. Various changes and modifications apparent to those skilled in the art can be made without departing from the scope of the invention as defined in the appended claims.

What is claimed is:

1. An improved battery cable, comprising:

an elongated electrically conductive cable formed by a multiplicity of wire strands;

a terminal member adapted to connect said electrically conductive cable to a projecting post of a storage battery;

said terminal member including a body having a forward portion and a rear portion;

said forward portion having a pair of forwardly extending arms which circumscribe and define an opening into which said projecting battery cable post can extend;

a tubular engagement member connecting said terminal member with said electrically conductive cable;

said tubular engagement member having a forward end and a rear end;

said tubular engagement member having a forward portion thereof, including said forward end, embedded within said rear portion of said terminal member, with the remainder of said tubular engagement member projecting beyond said terminal member rear portion;

said projecting portion of said tubular engagement member being cylindrical and said embedded forward end thereof being flattened and having a width in excess of the diameter of said cylindrical projecting portion;

said electrically conductive cable having one end thereof inserted into the projecting portion of said tubular engagement member;

said tubular engagement member being compressed inwardly along the projecting portion thereof to compress the wire strands therewithin into a substantially solid mass;

said electrically conductive cable including an insulating sheath surrounding said multiplicity of wire strands;

said insulating sheath at said one end of said electrically conductive cable terminating substantially at said rear end of said tubular engagement member to assure that said wire strands are unexposed; and a protective plastic tube extending along at least part of said tubular engagement member projecting portion and said insulating sheath and being heat shrunk into intimate contact therewith.

2. An improved battery cable as defined in claim 1 wherein said inwardly compressed area along said projecting portion of said tubular engagement member is diamond-shaped in cross-section.

3. An improved battery cable as defined in claim 1 wherein said tubular engagement member and said wire strands are formed of copper.

4. An improved battery cable as defined in claim 3 wherein said terminal member is formed of a lead-zinc alloy.

5. A battery terminal member adapted for coupling an electrically conductive cable to a post of a storage battery, said terminal member comprising:

a body having a pair of forwardly projecting arms which circumscribe and define an opening for reception of a storage battery post;

said body having a rear portion integrally connected with said arms and disposed rearwardly of said opening;

a hollow tubular member having its forward end engaged and embedded within said body rear portion;

said hollow tubular member projecting rearwardly from said body and extending beyond said body rear portion to receive and retain an end of an electrically conductive cable to be coupled to the storage battery post;

said projecting portion of said hollow tubular member being cylindrical and said embedded forward end thereof being flattened and having a width in excess of the diameter of said cylindrical projecting portion.

6. A battery terminal member as defined in claim 5 wherein said body is formed of a lead-zinc alloy and wherein said hollow tubular member is formed of copper.

7. A battery terminal member as defined in claim 6 wherein said opening is substantially circular and is generated about a first central axis, wherein said cylindrical tubular member is generated about a second central axis and wherein said first and second central axes are disposed perpendicularly to each other.

8. A battery terminal member as defined in claim 7 wherein said arms have a bore extending transversely therethrough for reception of a tightening member which can squeeze said arms toward each other to tighten said terminal member onto said battery post, said bore having a third central axis and said first, second and third central axes being disposed in mutually perpendicular arrangement.

9. A method of forming a battery cable comprising the steps of:

cutting a preselected length of sheathed electrically conductive multistrand cable;

stripping the sheathing from one end of said cable to expose said strands at said one end;

providing an electrically conductive metallic tube having a cylindrical configuration throughout most of its length and having a flattened forward end portion of a width in excess of the diameter of said cylindrical tube;

embedding said flattened forward end portion of said tube into a battery terminal member while permitting said cylindrical tubular portion to project at least partially therefrom;

inserting said exposed one end of said cable into said tube until said sheathing abuts against the end of said tube;

crimping at least a portion of said tube to compress said strands therein into a substantially solid mass which cannot be pulled out of said tube;

applying a heat shrinkable plastic covering over the crimped portion of said tube and over a portion of said sheathing; and heating said plastic covering to heat shrink it into tight contact with the tube and sheathing.

10. A method as defined in claim 9 wherein said crimping step comprises deforming said tube inwardly along four separate areas whereby said crimped tube is diamond-shaped in cross-section.

11. A method as defined in claim 9 further including the steps of:

stripping the sheathing from the opposite end of said cut cable to expose said strands at said other end;

providing a metallic connector member having a cavity formed therein;

inserting said exposed other end of said cable into said cavity until said sheathing abuts against the end of said connector member;

crimping said connector member to compress the strands within said cavity into a compact bundle which cannot be pulled out from said connector member;

applying a heat shrinkable plastic covering over the crimped portion of said connector member and over a portion of said sheathing; and heating said plastic covering to heat shrink it into tight contact with said connector member and sheathing.

* * * * *